US005783908A

United States Patent [19]

Toda et al.

[11] Patent Number: 5,783,908

[45] Date of Patent: Jul. 21, 1998

[54] LIGHTING CIRCUIT WHEREIN THE ABNORMALITY DETECTION CIRCUIT GETS ITS POWER DIRECTLY FROM THE AUXILIARY POWER SUPPLY SECTION

[75] Inventors: Atsushi Toda; Masayasu Yamashita; Goichi Oda, all of Shimizu, Japan

[73] Assignee: Koito Manufacturing Co., Ltd., Tokyo, Japan

[21] Appl. No.: 655,483

[22] Filed: May 30, 1996

[30] Foreign Application Priority Data

Jun. 14, 1995 [JP] Japan ..... 7-170473
Oct. 30, 1995 [JP] Japan ..... 7-305125

[51] Int. Cl.[6] ..... H05B 37/02

[52] U.S. Cl. ..... 315/82; 315/308; 315/DIG. 7; 315/224

[58] Field of Search ..... 315/82, 225, 224, 315/DIG. 7, 307, 308, 219, 209 R

[56] References Cited

U.S. PATENT DOCUMENTS

| | | | |
|---|---|---|---|
| 4,240,009 | 12/1980 | Paul | 315/224 |
| 4,251,752 | 2/1981 | Stolz | 315/DIG. 7 |
| 4,503,363 | 3/1985 | Nilssen | 315/DIG. 7 |
| 4,724,360 | 2/1988 | Luursema | 315/244 |
| 5,068,570 | 11/1991 | Oda et al. | 315/128 |
| 5,111,114 | 5/1992 | Wang | 315/225 |
| 5,140,229 | 8/1992 | Yagi et al. | 315/307 |
| 5,142,203 | 8/1992 | Oda et al. | 315/DIG. 7 |
| 5,151,631 | 9/1992 | Oda et al. | 315/127 |
| 5,198,728 | 3/1993 | Bernitz et al. | 315/307 |
| 5,212,428 | 5/1993 | Sasaki et al. | 315/308 |
| 5,278,452 | 1/1994 | Matsumoto et al. | 307/10.8 |
| 5,295,036 | 3/1994 | Yagi et al. | 361/79 |
| 5,422,548 | 6/1995 | Yamashita et al. | 315/308 |
| 5,449,973 | 9/1995 | Yamashita et al. | 315/82 |

*Primary Examiner*—Robert J. Pascal
*Assistant Examiner*—Michael Shingleton
*Attorney, Agent, or Firm*—Fitzpatrick, Cella, Harper & Scinto

[57] ABSTRACT

In a lighting circuit, a battery voltage is sent via a DC power supply section to a DC-AC converter to be converted to a square-wave AC voltage which is in turn supplied to a discharge lamp. The lighting circuit comprises an auxiliary power supply section for producing a predetermined voltage based on the input voltage from a battery and supplying this predetermined voltage to the individual sections of the lighting circuit and an abnormality detection circuit for detecting an abnormality in the discharge lamp, the circuit status, the battery voltage and so forth. In accordance with a signal from the abnormality detection circuit, a switch section, which is provided on a current line whose current is smaller than a current flowing on a power supply line to the discharge lamp, is switched on or off to enable or disable the auxiliary power supply section, thereby permitting or inhibiting power supply to the discharge lamp.

14 Claims, 9 Drawing Sheets

53
HS
72
73
TIME CONSTANT CIRCUIT
74
+Vcc1
80
79
75
LATCH CIRCUIT
76
81
78
77
RS

LIGHTING CIRCUIT WHEREIN THE ABNORMALITY DETECTION CIRCUIT GETS ITS POWER DIRECTLY FROM THE AUXILIARY POWER SUPPLY SECTION

BACKGROUND OF THE INVENTION

1. Field of the Invention

The present invention relates to a novel lighting circuit for a discharge lamp, which stops operating an auxiliary power supply section for supplying a predetermined voltage to individual sections of the lighting circuit or inhibits the output voltage of the auxiliary power supply section to cut off power supply to the discharge lamp by switch means, provided on a current line whose current is smaller than a current flowing on a power supply line to the discharge lamp, when an abnormality in a discharge lamp, a circuit failure or the like is detected, whereby the withstand current capacity and the contact capacity of the switch means can be reduced.

2. Description of the Related Art

Recently, compact discharge lamps (e.g., metal halide lamps) are receiving greater attention as a light source to take the place of an incandescent lamp. To adapt this lamp to the light source, for a vehicular lamp, for example, it is necessary to stop the operation of the lighting circuit when an abnormality in the lighting circuit is detected, thereby preventing a short-circuiting accident or the like.

In a lighting circuit a shown in FIG. 9, for example, the voltage from a battery b is supplied to a lighting control section c between whose output terminals d and d' a discharge lamp e is connected. When an abnormality detection circuit f detects an abnormality in the discharge lamp e or the circuit, a switch section h provided on a power supply line g which connects the battery b to the lighting circuit a is opened to inhibit the supply of the battery voltage to the lighting control section c.

Because the switch section h for activating and deactivating the lighting control section c is provided on the power supply line g extending from the battery b to the discharge lamp e, the contact capacity or the withstand current capacity of the switch section h should be increased. This makes it difficult to reduce the manufacturing cost, disadvantageously.

SUMMARY OF THE INVENTION

Accordingly, it is an objective of the present invention to provide a lighting circuit for a discharge lamp, which stops operating an auxiliary power supply section or inhibits the output of the auxiliary power supply section to cut off power supply to the discharge lamp by switch means, provided on a current line whose current is smaller than a current flowing on a power supply line to the discharge lamp, when an abnormality in a discharge lamp, a circuit failure or the like is detected, whereby the withstand current capacity and, the contact capacity of the switch means can be reduced.

To achieve this object, according to the present invention, there is provided a lighting circuit for a discharge lamp, designed to supply an input voltage from a DC power supply to a discharge lamp via a DC power supply section, which circuit comprises:

an auxiliary power supply section for producing a predetermined voltage based on the input voltage from the DC power supply and supplying the predetermined voltage to individual sections of the lighting circuit;

an abnormality detection circuit for detecting an abnormality in the discharge lamp or the lighting circuit; and switch means for permitting or stopping power supply to the individual sections of the lighting circuit from the auxiliary power supply section in accordance with a detection signal from the abnormality detection circuit, thereby permitting or inhibiting power supply to the discharge lamp.

It is preferable that the auxiliary power supply section have a smaller power capacity than the DC power supply section.

It is also preferable that the switch means should be provided on a current line whose current is smaller than a current flowing on a power supply line to the discharge lamp.

According to the lighting circuit of this invention, because the switch means, which is provided on a current line whose current is smaller than a current flowing on a power supply line to the discharge lamp, permits or stops power supply to the individual sections of the lighting circuit from the auxiliary power supply section in accordance with the detection signal from the abnormality detection circuit, thereby permitting or inhibiting power supply to the discharge lamp, the contact capacity or the withstand current capacity of the switch means need not be increased.

BRIEF DESCRIPTION OF THE DRAWINGS

FIG. 1 is a block diagram showing the circuit structure of the lighting circuit according to the first embodiment;

FIG. 2 is a circuit diagram exemplifying the structure of an auxiliary power supply section;

FIG. 3 is a circuit diagram showing an example of a bridge type driver of a DC-AC converter; and FIG. 4 is a circuit diagram exemplifying the structure of a drive controller of the DC-AC converter.

FIG. 5 is a circuit diagram of the essential portions of the lighting circuit according to the second embodiment;

FIG. 6 is a diagram showing one example of a detection circuit associated with a battery voltage; and FIG. 7 is a diagram exemplifying a holding circuit.

DETAILED DESCRIPTION OF THE PREFERRED EMBODIMENTS

Lighting circuits for a discharge lamp according to preferred embodiments of the present invention will now be described in detail with reference to the accompanying drawings. In the illustrated embodiments, this invention is adapted for a lighting circuit of an AC square-wave activation type.

FIGS. 1 through 4 illustrate the first embodiment of this invention.

Figure 1:
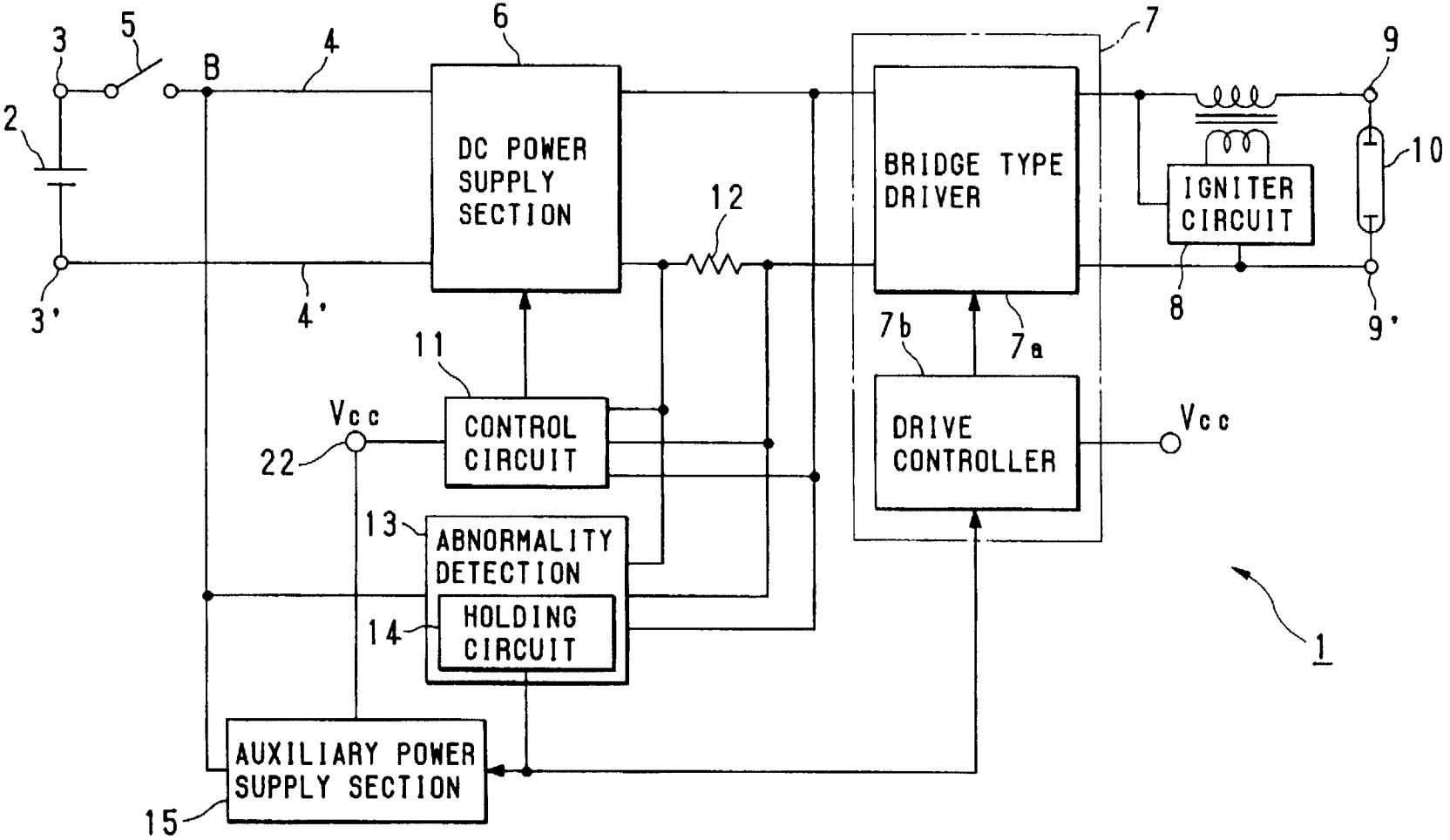
FIGS. 1 through 4 illustrate a lighting circuit according to the first embodiment of the present invention.

FIG. 1 shows the outline of a lighting circuit 1. A battery 2 is connected between DC voltage input terminals 3 and 31, and a lighting switch 5 is provided as a manual switch on one of two DC power lines 4 and 4', or the DC power line 4.

In this embodiment, a DC power supply section 6 which receives a battery voltage (denoted by "B") is a DC booster/step-down circuit that boosts and/or reduces the battery voltage B and sends its output to a DC-AC converter 7 located at the subsequent stage.

The DC-AC converter 7 converts the output voltage of the DC power supply section 6 to a square-wave AC voltage. This DC-AC converter 7 comprises a battery voltage bridge type driver *7a* provided on the power supply path to a discharge lamp 10, and a drive controller *7b* for controlling the bridge type driver *7a*.

An igniter circuit 8 is provided at the subsequent stage of the DC/AC converter 7 and has AC output terminals 9 and 9' between which the discharge lamp 10 is connected. It is to be noted that a metal halide lamp having the rated power of, for example, 35 W is used as the discharge lamp 10.

A control circuit 11 controls the output voltage of the DC power supply section 6. The control circuit 11 generates a control signal according to the output voltage of the DC power supply section 6 and/or the output current of the DC power supply section 6, which is detected by a current detecting resistor 12 provided on the ground line that connects the DC power supply section 6 to the DC-AC converter 7. The control circuit 11 sends the control signal to the DC power supply section 6 to control the output voltage thereof. Accordingly, the control circuit 11 performs power control which matches with the status of the discharge lamp 10 when activated, thereby shortening the activation time and the re-activation time of the discharge lamp 10 and ensuring the stable lighting control in a steady lighting mode.

An abnormality detection circuit 13 serves to detect an abnormality in the discharge lamp 10 or the lighting circuit. The abnormality detection circuit 13 detects the output voltage and/or the output current of the DC power supply section, the battery voltage B or the like to detect an abnormal load of the discharge lamp 10, the short-circuiting of the output terminals 9 and 9', the overvoltage state or the abnormal dropping of the battery voltage B, etc., for example. In this embodiment, a detection signal associated with the output of the DC power supply section 6, which is equivalent to the lamp voltage or the lamp current of the discharge lamp 10 is input as a power control signal to the control circuit 11, thereby simplifying the circuit structure. Instead of the detection signal associated with the output of the DC power supply section 6, the lamp voltage or the lamp current of the discharge lamp 10 may be detected at the subsequent stage of the DC-AC converter 7 to thereby detect an abnormality in the discharge lamp 10 or the lighting circuit.

The abnormality detection circuit 13 includes a holding circuit 14 which holds the detection signal until the lighting switch 5 is switched on again when an abnormality in the discharge lamp 10 or the lighting circuit is detected. The output signal of the holding circuit 14 is sent to the drive controller *7b* of the DC power supply section 7 and an auxiliary power supply section 15.

The auxiliary power supply section 15 is provided as a circuit of a separate system from the power supply path to the discharge lamp 10, and produces a voltage necessary for the individual sections of the lighting circuit 1. The auxiliary power supply section 15 receives the battery voltage B at the subsequent stage of the lighting switch 5. The voltage produced by the auxiliary power supply section 15 (denoted by "Vcc") is supplied as a supply voltage to the control circuit 11, the abnormality detection circuit 13 and so forth, and is used as a predetermined reference voltage or the original voltage for the reference voltage. The auxiliary power supply section 15 is designed to be disabled by an abnormality detection signal from the abnormality detection circuit 13. The power capacity of the auxiliary power supply section 15 is set smaller than that of the DC power supply section 6.

Figure 2:
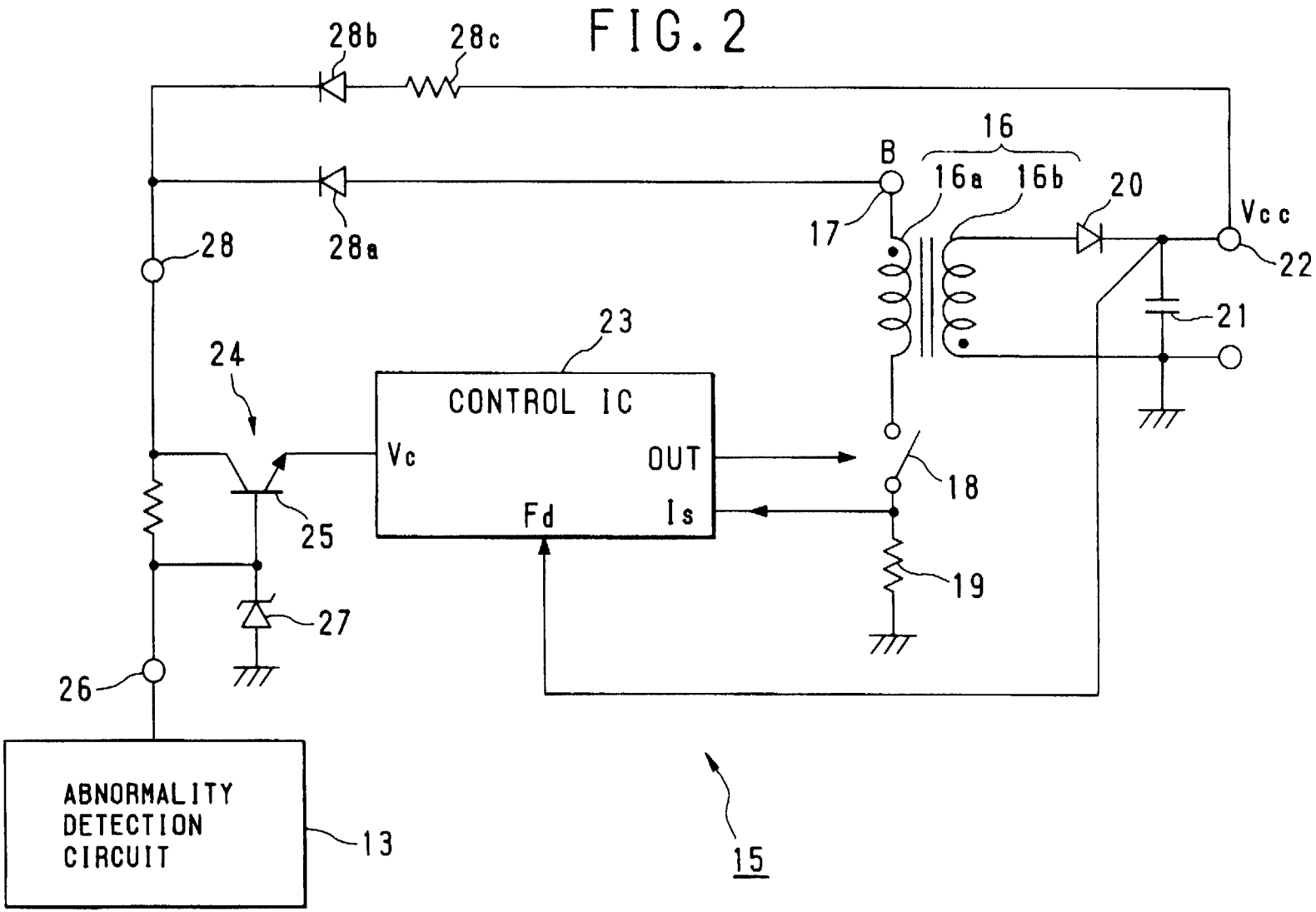

FIG. 2 exemplifies the structure of the auxiliary power supply section 15 which takes the structure of a flyback transformer.

A transformer 16 has a primary winding *16a* whose one end is connected to a terminal 17 that is supplied with the battery voltage B, and whose other end is grounded via a semiconductor switch element 18 (indicated by the symbol of a switch in the diagram) and a resistor 19. The transformer 16 has a secondary winding *16b* whose output is rectified and smoothed by a diode 20 and a capacitor 21 whose terminal voltage is acquired as Vcc from a terminal 22.

The control IC 23 is provided to send a signal to the semiconductor switch element 18 from its output terminal (OUT) to execute the switching control of the switch element 18. The current detected through the resistor 19 is sent to the detection terminal (Is) of the control IC 23, and the terminal voltage of the capacitor 21 is fed back to the feedback terminal (Fd) of the control IC 23.

Connected to the voltage supply terminal (Vc) of the control IC 23 is a switch section 24 for determining whether or not to supply an output voltage. The switch section 24 is switched on or off in accordance with the signal from the abnormality detection circuit 13. The switch section 24 may be a mechanical switch like a relay contact. In this embodiment, however, the switch section 24 uses an NPN transistor 25 as a semiconductor switch element. The base of the transistor 25 is connected to a terminal 26 to which the output signal of the abnormality detection circuit 13 is supplied and is grounded via a Zener diode 27. The transistor 25 has a collector connected to a terminal 28 and an emitter connected to the voltage supply terminal (Vc) of the control IC 23. The terminal 28 is connected via a diode *28a* to the aforementioned terminal 17, and is also connected via a diode *28b* and a resistor *28c* to the terminal 22.

When a signal indicative of an abnormality in the lighting circuit or the like is supplied to the terminal 26 of the auxiliary power supply section 15 from the abnormality detection circuit 13, thereby disabling the transistor 25, the supply of the output voltage to the control IC 23 is stopped. As a result, the power supply to the control circuit 11, etc. from the auxiliary power supply section 15 is cut off to stop the lighting operation, thus inhibiting the power supply to the discharge lamp 10. In this case, the current flowing through the transistor 25 has a value of about several hundreds of milliamperes, and the current flowing through the power supply line to the discharge lamp 10 reaches as high as a several tens of amperes. It is therefore to be understood that the cutoff current of the transistor 25 can be reduced by a factor of several hundreds.

The diode *28b* and resistor *28c*, intervened between the terminals 22 and 28, are provided to suppress the influence of the temporary dropping of the battery voltage B. When the battery voltage B falls, the diode *28b* conducts to allow the output from the terminal 22 to compensate for the voltage at the terminal 28. That is, the transistor 25 is prevented from immediately being turned off by the temporary dropping of the battery voltage B.

If the auxiliary power supply section 15 has a smoothing capacitor 21 at its output means, power supply to the control circuit 11, etc. is not immediately cut off even when the operation of the auxiliary power supply section 15 is stopped, and the power supply continues for a little while.

During this period, the operations of the DC power supply section 6 and the DC-AC converter 7 are not completely stopped so that the current is kept flowing to the discharge lamp 10. It is therefore preferable to send a signal to the DC-AC converter 7 from the abnormality detection circuit 13 to immediately stop the operation of the DC-AC converter 7.

Figure 3:
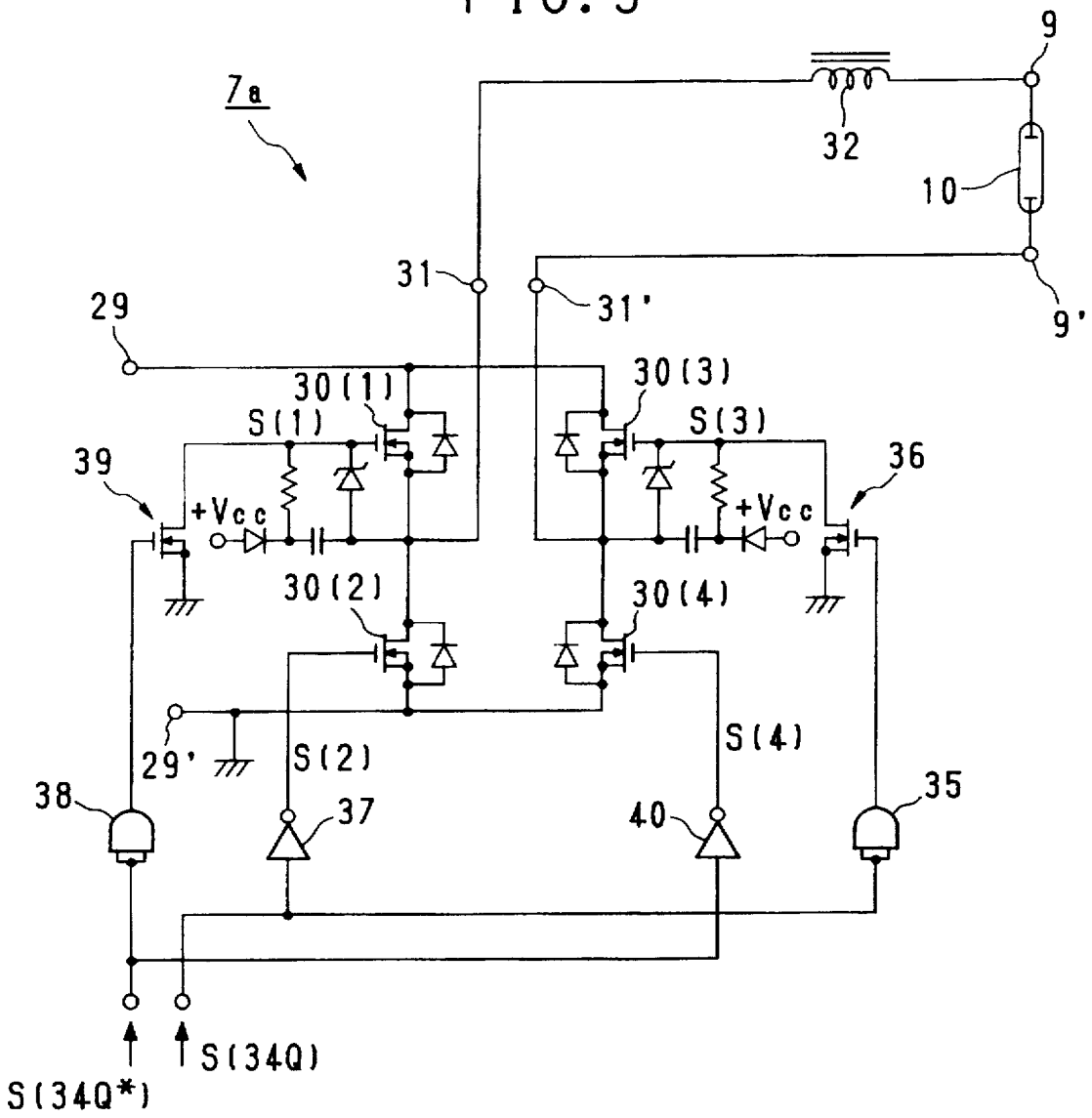

FIG. 3 exemplifies the structure of the bridge type driver 7*a* of the DC-AC converter 7, which takes the two-stage bridge structure using FETs, for example. The switching control of the FETs is executed by a control signal sent to the FETs from the drive controller 7*b*.

Reference numeral 112911 denotes a DC voltage input terminal or a positive input terminal and reference numeral 1129111 denotes another DC voltage input terminal or a ground input terminal. The output voltage of the DC power supply section 6 is applied to those input terminals 29 and 29'.

The bridge type driver 7*a* is comprised of four N channel FETs 30(i) (i=1, 2, 3, 4). The FETs 30(1) and 30(2) are connected in series, and the FETs 30(3) and 30(4) are connected in series. Those two series circuits of FETs are arranged in parallel to each other. More specifically, the FET 30(1) at the upper stage has a drain connected to the positive input terminal 29 and a source connected to the drain of the lower-stage FET 30(2) whose source is connected to the ground input terminal 29'. With regard to the FETs 30(3) and 30(4) arranged in parallel to the FETs 30(1) and 30(2), the upper-stage FET 30(3) has a drain connected to the positive input terminal 29 and a source connected to the drain of the lower-stage FET 30(4) whose source is connected to the ground input terminal 29'.

A Zener diode is inserted between the gate and source of the FET 30(1) and another Zener diode is likewise inserted between the gate and source of the FET 30(3), with a capacitor and a resistor provided between the anode of each Zener diode and the gate of the associated FET. A predetermined voltage (Vcc) is applied between each pair of the capacitor and resistor via a diode.

An output terminal 31 is connected to the source of the FET 30(1), and an output terminal 31' is connected to the source of the FET 30(3), so that a square-wave output voltage is applied to the discharge lamp 10 via an inductor 32.

The inductor 32 is equivalent to the secondary winding of a trigger transformer which is provided in the igniter circuit 8 to generate an activation pulse to the discharge lamp 10.

With regard to the switching control of the FETs 30(i) (i=1, 2, 3, 4), control signals S(i) (i=1, 2, 3, 4) are sent to the individual FETs from the drive controller 7*b* in such a way as to complimentarily control two sets of the obliquely arranged FETs.

Figure 4:
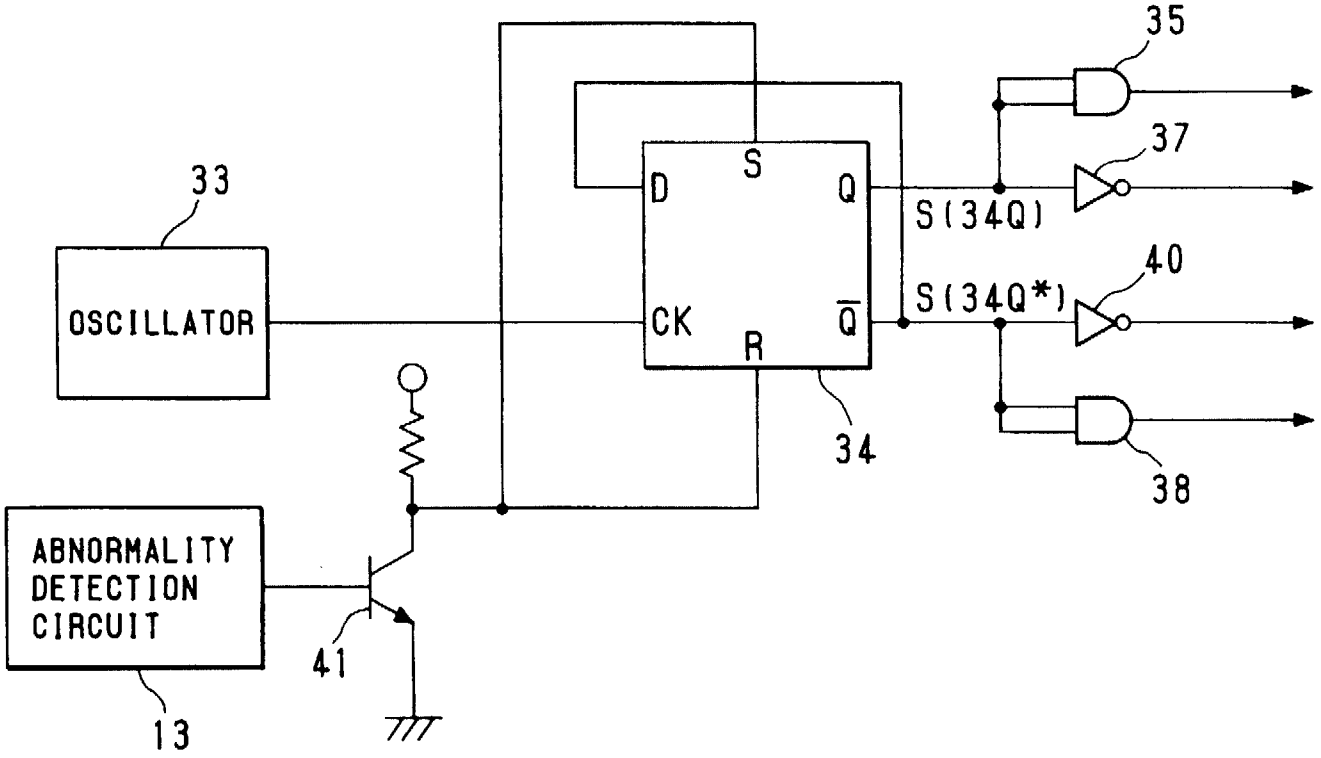

The drive controller 7*b* comprises an oscillator 33 and a frequency divider 34 as shown in FIG. 4.

The oscillator 33 generates a clock signal, which is in turn sent to the clock input terminal (CK) of the frequency divider 34.

The frequency divider 34 is constituted by using a D type flip-flop whose two output signals have opposite phases to each other. As shown in FIGS. 3 and 4, one of the output signals (which is indicated by "S(34Q)") is sent to the gate of the FET 30(3) via a buffer 35 and an FET 36, and to the gate of the FET 30(2) via a NOT gate 37, while the other output signal (indicated by IS5(34Q*)IY) is sent to the gate of the FET 30(1) via a buffer 38 and an FET 39, and to the gate of the FET 30(4) via a NOT gate 40. Accordingly, a pair of the FETs 30(2) and 30(3) and a pair of the FETs 30(1) and 30(4) are complimentarily switched with a dead time between switching. The D terminal of the frequency divider 34 is connected to the /Q output terminal.

The output signal of the abnormality detection circuit 13 is sent to the base of an emitter-grounded transistor 41, and the collector output of the transistor 41 is sent to the set terminal (S) and the reset terminal (R) of the frequency divider 34. When the transistor 41 is turned off by the abnormality detection signal, the two output signals of the frequency divider 34 both become H (High)-level signals, disabling all the FETs 30(i) (i=1, 2, 3, 4).

In the lighting circuit 1, as described above, when an abnormality in the discharge lamp 10 or the lighting circuit is detected by the abnormality detection circuit 13, the operation of the auxiliary power supply section 15 is stopped by the signal which is sent to the auxiliary power supply section 15 from the abnormality detection circuit 13, cutting off the power supply to the control circuit 11, etc. from the auxiliary power supply section 15. Further, the operation of the bridge type driver 7*a* of the DC-AC converter 7 is stopped immediately by the signal which is sent to the drive controller 7*b* of the DC-AC converter 7 from the abnormality detection circuit 13.

As the switch section 24 for controlling the power supply to the auxiliary power supply section 15 is provided on the current line whose current is smaller than the current which flows on the power supply line to the discharge lamp 10, it is unnecessary to use a switch element whose withstand current capacity or contact capacity is large.

Although the supply of the supply voltage to the control circuit 11, etc. from the auxiliary power supply section 15 is stopped w hen an abnormality is detected in this embodiment, the method of disabling the control circuit 11, etc. is not limited to this inhibition of the supply of the supply voltage. When the IC which constitutes the control circuit 11 has a stop terminal, for example, a predetermined voltage should be applied to this terminal. Alternatively, an error signal may be intentionally supplied to the internal circuit (error amplifier or the like) of the IC to stop the operation of the IC. That is, any method may be employed as long as the operation of the control circuit 11, etc. is stopped by the signal sent to the control circuit 11, etc. from the auxiliary power supply section 15.

Figure 5:
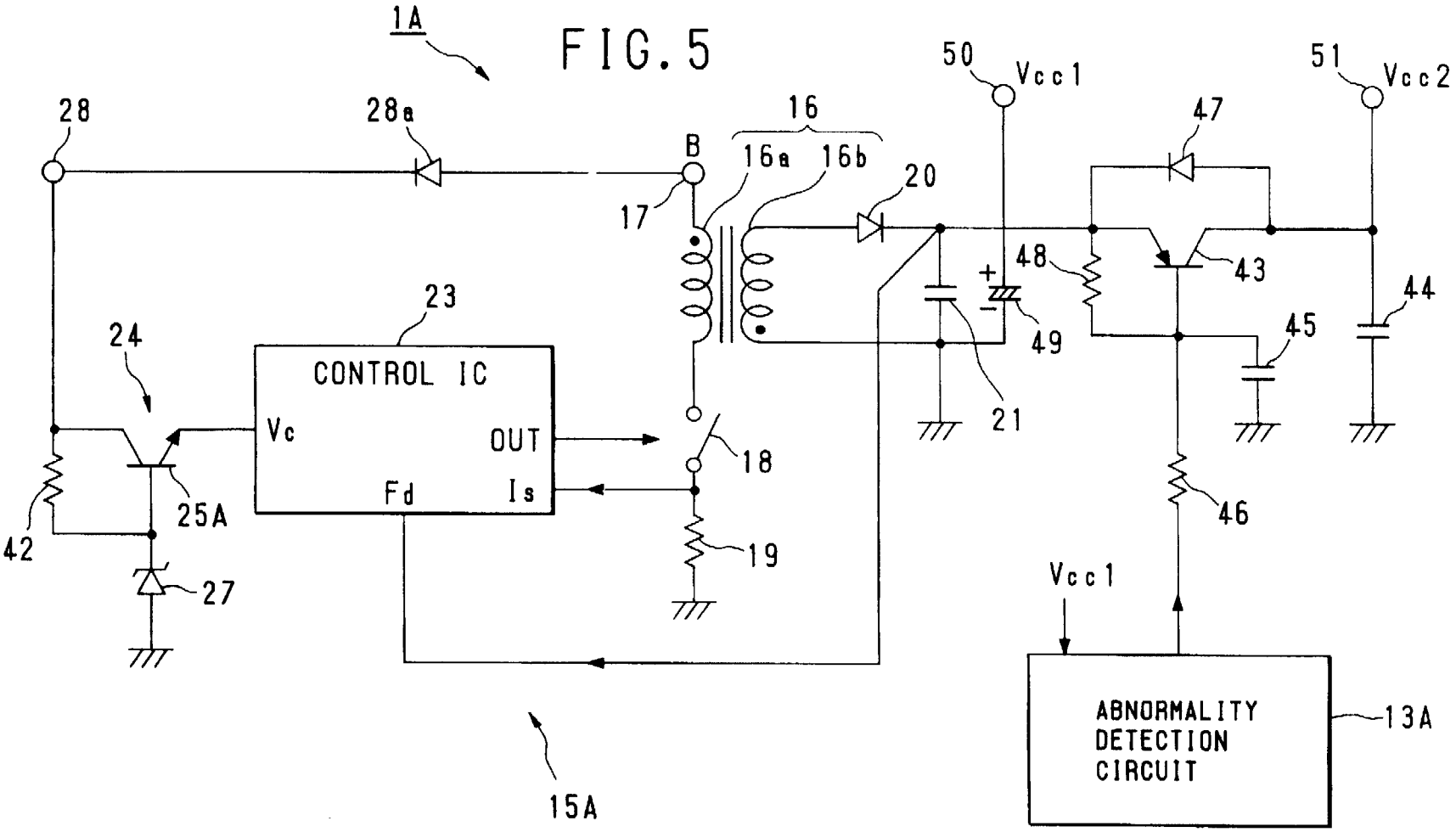
FIGS. 5 through 7 illustrate a lighting circuit according to the second embodiment of this invention.

FIG. 5 illustrates a lighting circuit 1A according to the second embodiment of this invention.

The second embodiment mainly differs from the first embodiment in that switch means is provided at the output stage of the auxiliary power supply section 15 to cut off power supply to the control circuit, etc. when an abnormality is detected, and it is the same as the first embodiment in most of the other parts. To avoid the redundant description, therefore, like or same reference numerals are given to those components of the second embodiment which are the same as the corresponding components of the first embodiment.

A transistor 25A intervened between the terminal 28 and the voltage supply terminal Vc of the control IC 23 in an abnormality detection circuit 15A shown in FIG. 5 is provided simply to ensure a constant voltage and is not switched by the signal from an abnormality detection circuit 13A. More specifically, the transistor 25A has a base grounded via a Zener diode 27, a collector connected to the terminal 28 and an emitter connected to the voltage supply terminal Vc of the control IC 23. A resistor 42 is inserted between the base and collector of the transistor 25A.

The switch means whose ON/OFF control is carried out by the signal from the abnormality detection circuit 13A is a PNP transistor 43 which is provided at the output stage of the auxiliary power supply section 15A. This transistor 43 has an emitter connected between the diode 20 and the capacitor 21 and a collector grounded via a capacitor 44. The base of the transistor 43 is grounded via a capacitor 45 and is connected to the output terminal of the abnormality detection circuit 13A via a resistor 46. A diode 47 is inserted between the collector and emitter of the transistor 43, and a resistor 48 is inserted between the base and emitter of the transistor 43.

A capacitor 49 is connected in parallel to the capacitor 21, and its terminal voltage (indicated by "Vcc1") is acquired from a terminal 50 to be supplied as the supply voltage to the abnormality detection circuit 13A.

The terminal voltage of the capacitor 44 (indicated by "Vcc2") is acquired from a terminal 51 to be supplied to the control circuit 11, the DC-AC converter 7, etc.

Figure 6:
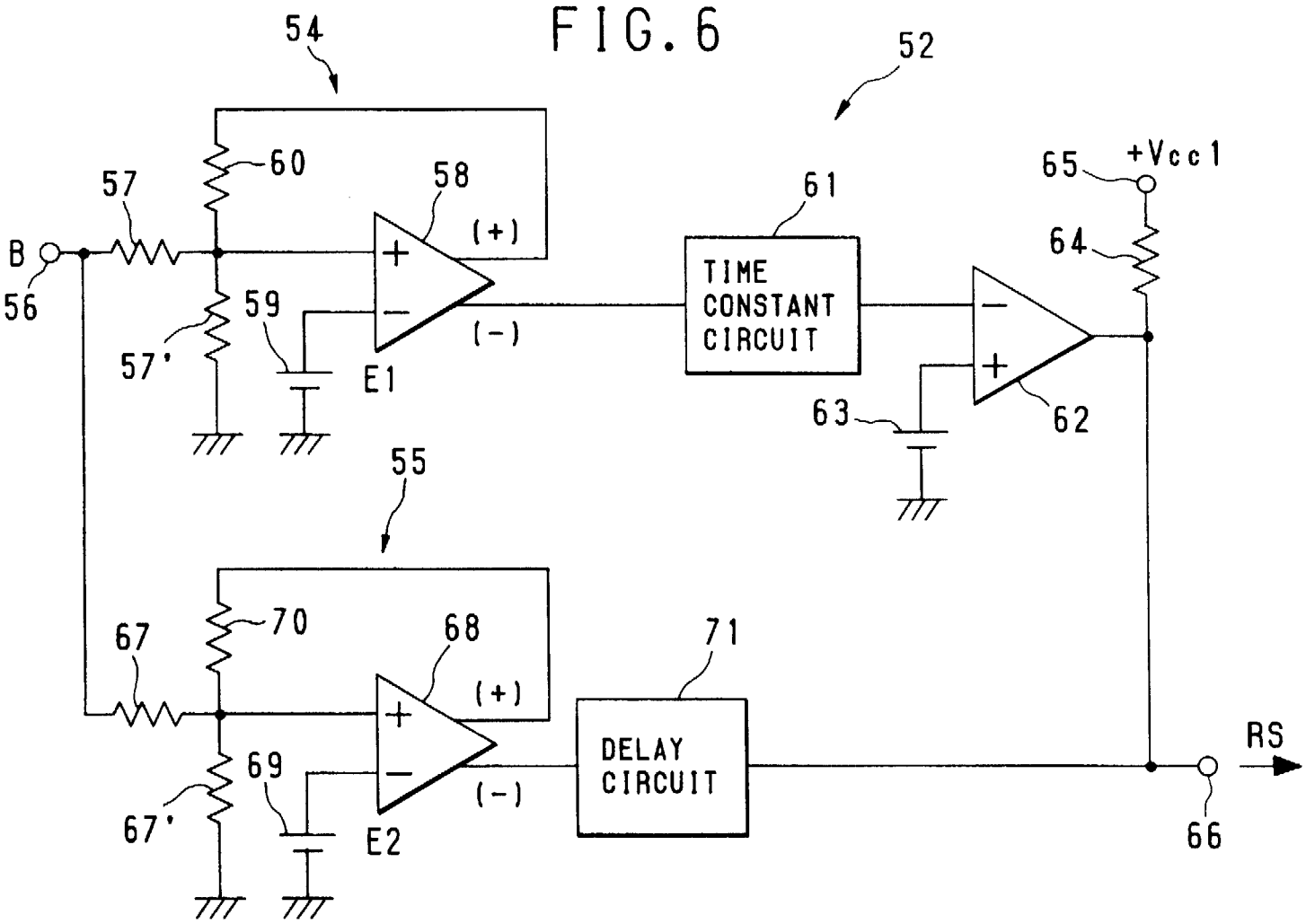
Figure 7:
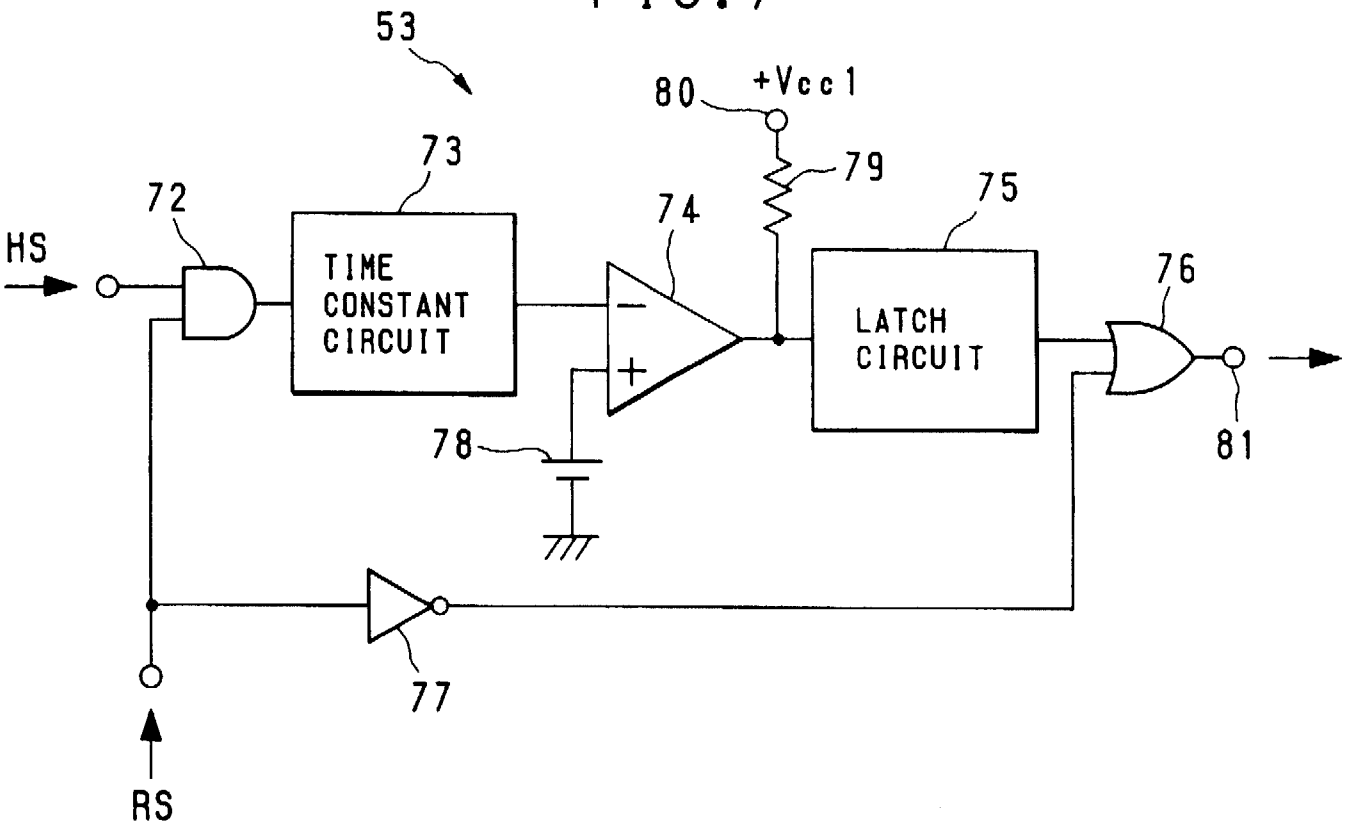

FIGS. 6 and 7 exemplify the structure of the abnormality detection circuit 13A. FIG. 6 shows a circuit 52 which detects if the battery voltage B lies within a predetermined range, and FIG. 7 shows a holding circuit 53 which holds the abnormality detection signal.

The circuit 52 includes a circuit section 54 for detecting if the battery voltage B abnormally drops below a predetermined value and a circuit section 55, provided in parallel to the circuit section 54, for detecting if the battery voltage B exceeds a predetermined value to be an overvoltage state.

The battery voltage B to be input to the terminal 56 is input to the positive input terminal of a comparator 58 via voltage dividing resistors 57 and 57', and a predetermined reference voltage (indicated by "E1") is supplied to the negative input terminal of the comparator 58 from a constant voltage supply 59. The comparator 58 constitutes the circuit section 54. The comparator 58 has two output terminals OUT(+) and OUT(−). The comparator 58 outputs an H-level signal from the output terminal OUT(+) when the positive input voltage to the comparator 58 is greater than the negative input voltage, and outputs an L (Low)-level signal from the output terminal OUT(+) when the positive input voltage is smaller than the negative input voltage. The comparator 58 outputs an L-level signal from the output terminal OUT(−) when the positive input voltage to the comparator 58 is greater than the negative input voltage, and outputs an H-level signal from the output terminal OUT(−) when the positive input voltage is smaller than the negative input voltage.

As illustrated, the output terminal OUT(+) is connected between the resistors 57 and 57' via a resistor 60, and the output terminal OUT(−) is connected to the negative input terminal of a comparator 62 via a time constant circuit 61. A reference voltage from a constant voltage supply 63 is supplied to the positive input terminal of the comparator 62 whose output terminal is connected to a power supply terminal 65 for the terminal voltage Vcc1 via a resistor 64 and to a detection output terminal 66.

When the battery voltage B becomes smaller than a predetermined voltage equivalent to the reference voltage El, the output signal from the output terminal OUT(-) of the comparator 58 becomes an H-level signal. This charges a capacitor which constitutes the time constant circuit 61. When the output of the time constant circuit 61 exceeds the reference voltage indicating the voltage from the constant voltage supply 63, the output signal of the comparator 62 becomes an L-level signal which is output as a signal (indicated by "RS") from the detection output terminal 66.

The battery voltage B to be supplied to the terminal 56 is input to the positive input terminal of a comparator 68, which constitutes the circuit section 55, via voltage dividing resistors 67 and 67', and a predetermined reference voltage (indicated by "E2") is supplied to the negative input terminal of the comparator 68 from a constant voltage supply 69. The comparator 68 has two output terminals OUT(+) and OUT (−), which are the same as those of the comparator 58 discussed previously. The output terminal OUT(+) of the comparator 68 is connected between the resistors 67 and 67' via a resistor 70, and the output terminal OUT(−) is connected to the detection output terminal 66 via a delay circuit 71.

When the battery voltage B exceeds a predetermined voltage equivalent to the reference voltage E2, the output signal from the output terminal OUT(−) of the comparator 68 becomes an L-level signal, which is output as the signal RS from the detection output terminal 66.

It is to be noted that the comparators 58 and 68 have hysteresis characteristics in consideration of the influence of the line drop, and that the time constant circuit 61 and the delay circuit 71 are provided in the light of an AC-like variation of the battery voltage B.

As shown in FIG. 7, the holding circuit 53 has a two-input AND gate 72, a time constant circuit 73, a comparator 74, a latch circuit 75, a two-input OR gate 76 and a NOT gate 77. A detection signal (indicated by "HS") and the aforementioned signal RS are to be input to the AND gate 72. The detection signal HS becomes an H-level signal when an abnormality occurs in various unillustrated detecting circuits, such as the detection of the open or short-circuited state of the load, the detection of the supply of the overpower, overvoltage or the like to the discharge lamp, or the detection of the supply of an insufficient voltage to the discharge lamp.

The output signal of the AND gate 72 is sent to the negative input terminal of the comparator 74 via the time constant circuit 73, which includes a resistor and a capacitor, and is compared with a reference voltage from a constant voltage supply 78 which is supplied to the positive input terminal of the comparator 74.

The output terminal of the comparator 74 is connected via a resistor 79 to a power supply terminal 80 for the terminal voltage Vcc1, and is also connected to the input terminal of the latch circuit 75. The output of the latch circuit 75 is sent to one of the input terminals of the OR gate 76. The aforementioned detection signal RS is input via the NOT gate 77 to the other input terminal of the OR gate 76 whose output signal is sent out from a terminal 81. This output signal is sent to the aforementioned transistor 43 as the output signal of the abnormality detection circuit 13A.

When the signal HS and the signal RS become H-level signals, i.e., when the battery voltage B is not abnormal and another abnormality is detected, the output signal of the AND gate 72 becomes an H-level signal so that the output of the time constant circuit 73 increases with a predetermined time constant. The comparator 74 compares the output of the time constant circuit 73 with the reference voltage from the constant voltage supply 78. When the output of the time constant circuit 73 becomes greater than this reference voltage, the output of the comparator 74 becomes an L-level signal, causing the output of the latch circuit 75 at the subsequent stage to change its level to the H level from the L level. This state is held (latched). Therefore, the transistor 43 is turned off by the H-level signal output from the OR gate 76 and this state continues until the lighting circuit is powered on again.

When the signal RS is an L-level signal, i.e., when the overvoltage state or abnormal dropping of the battery voltage B is detected, the output signal of the AND gate 72 becomes an L-level signal to inhibit the holding of the signal HS. As the H-level signal output from the NOT gate 77 is sent to the OR gate 76, the output of the OR gate 76 becomes an H-level signal regardless of the output of the latch circuit 75. As a result, the transistor 43 is turned off. When the battery voltage B is restored to the normal range thereafter, the signal RS becomes an H-level signal, thus releasing the inhibition of the holding of the signal HS.

In the lighting circuit 1A, when an abnormality in the discharge lamp 10 or the lighting circuit is detected by the abnormality detection circuit 13A, the power supply to the control circuit 11, etc. from the auxiliary power supply section 15A is cut off. Since the transistor 43 is provided on the current line whose current is smaller than the current which flows through the power supply line to the discharge lamp 10, however, it is unnecessary to use a switch element having a large withstand current capacity or a large contact capacity.

As the stable voltage Vcc1, not the battery voltage B, is supplied as the supply voltage to the abnormality detection circuit 13A, a particular circuit for reducing the influence of a variation in the battery voltage need not be provided in the abnormality detection circuit 13A. This contributes to simplification of the overall circuit structure, thus preventing the circuit scale from becoming large or the manufacturing cost from increasing.

The reason why the voltage Vcc1 to be supplied to the abnormality detection circuit 13A is acquired from the supply voltage produced by the auxiliary power supply section 15A is because this design is suitable for integrating the abnormality detection circuit 13A into an IC (Integrated Circuit). If two power supply paths to the abnormality detection circuit 13A are provided respectively for the battery voltage B and the voltage Vcc1, this structure hinders the integration of the abnormality detection circuit 13A to an IC. If the battery voltage B varies considerably, the use of such a battery voltage as the supply voltage is undesirable for the proper detecting operation, higher detecting precision and the like.

Figure 8:
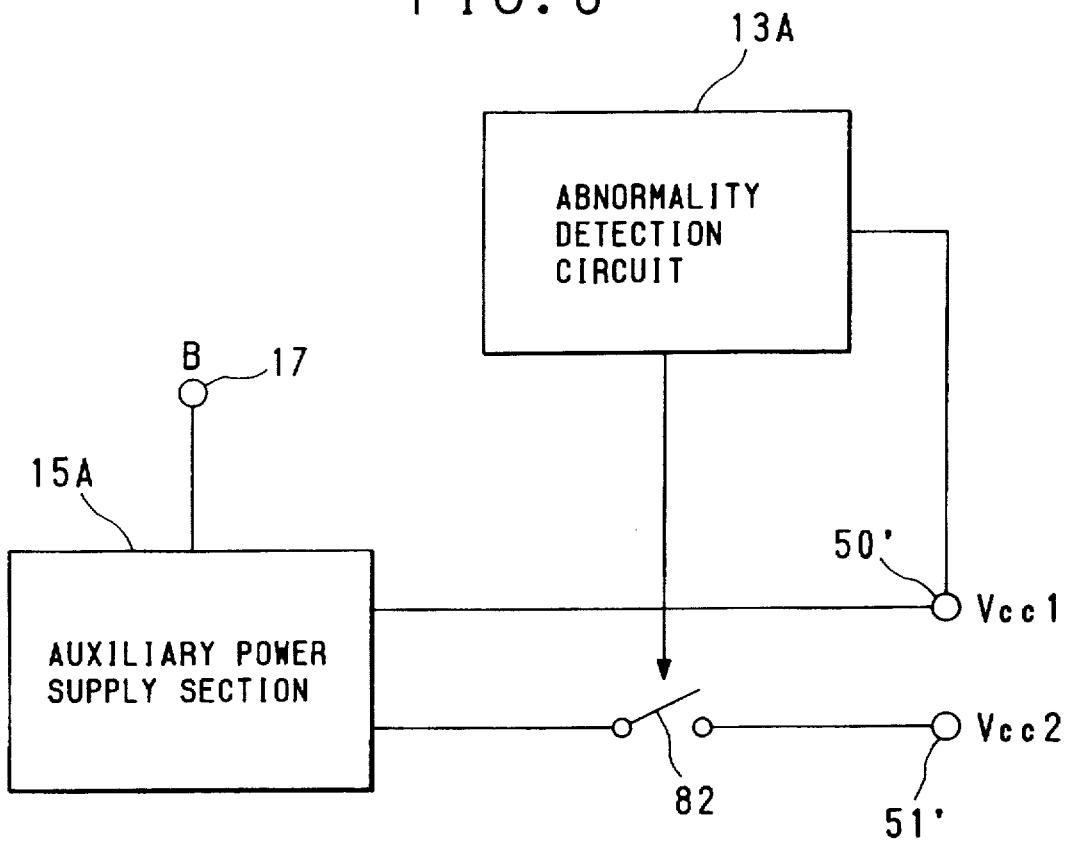
FIG. 8 is a diagram showing a modification of the output system of the auxiliary power supply section.
Figure 9:
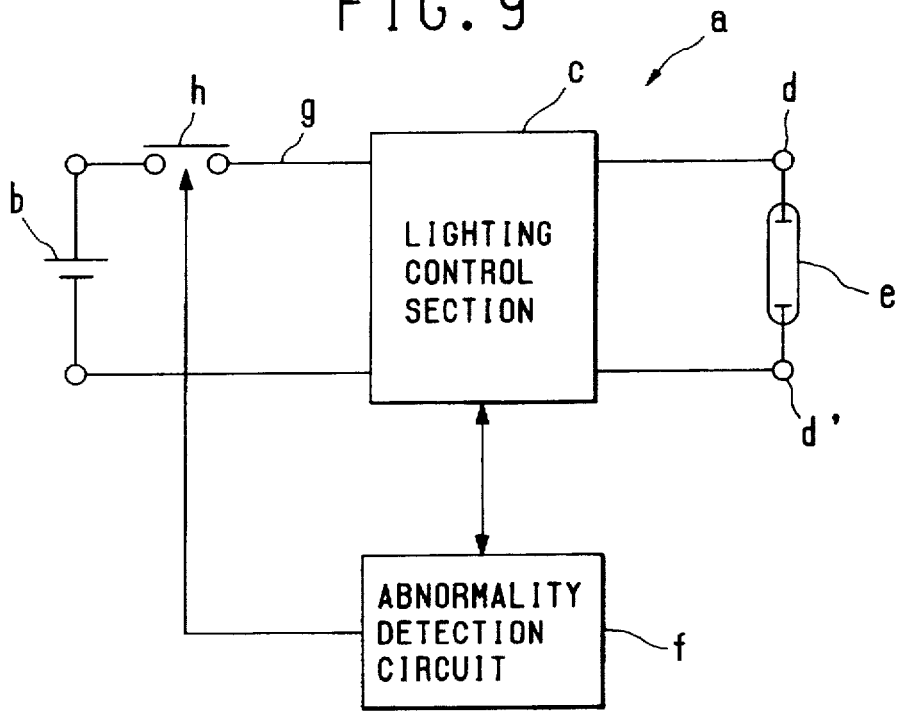
FIG. 9 is a circuit diagram illustrating the structure of a conventional lighting circuit.

Although the second embodiment is so designed as to acquire the voltage Vcc2 from the voltage Vcc1 output from the auxiliary power supply section 15A via the switch means (the transistor 43), this invention is not restricted to this particular structure. As shown in FIG. 8, for example, switch means 82 may be provided on the path which is associated with the supply voltage Vcc2 (see a terminal 51' in the diagram), not the supply voltage Vcc1 (both Vcc1 and Vcc2 are output from the auxiliary power supply section 15A). In this modification, the ON/OFF action of the switch means 82 is controlled by the signal from the abnormality detection circuit 13A to inhibit the supply of the voltage Vcc2 to the control circuit 11, etc. when an abnormality is detected. At this time, the supply of the voltage Vcc1 (see a terminal 50' in the diagram) to the abnormality detection circuit 13A is maintained.

As apparent from the above description, the switch means which is provided on the current line whose current is smaller than the current flowing through the power supply line to the discharge lamp allows or stops power supply to the individual sections of the lighting circuit from the auxiliary power supply section in accordance with the detection signal from the abnormality detection circuit. It is therefore unnecessary to increase the contact capacity or the withstand current capacity of the switch means, thus contributing to reducing the manufacturing cost and the circuit scale.

Further, the switch means enables or disables the auxiliary power supply section in accordance with the detection signal from the abnormality detection circuit to thereby permit or inhibit power supply to the discharge lamp. The value of the cutoff current of the switch means should be as small as the one needed to operate the auxiliary power supply section.

Furthermore, the supply voltage stabilized by the auxiliary power supply section is supplied to the abnormality detection circuit, and the switch means is provided at the output stage of the auxiliary power supply section. This design can ensure circuit protection by cutting off the power to the discharge lamp without being influenced by a variation in the input voltage from the DC power supply, when an abnormality is detected.

Moreover, the inhibition means for inhibiting the operation of the DC-AC converter upon reception of the abnormality detection signal from the abnormality detection circuit is provided to quickly and surely stop the operation of the lighting circuit when an abnormality is detected.

What is claimed is:

1. A lighting circuit for a discharge lamp, designed to supply an input voltage from a DC power supply to a discharge lamp via a DC power supply section, said lighting circuit comprising:

an auxiliary power supply section for producing a predetermined voltage based on said input voltage from said DC power supply and supplying said predetermined voltage to individual sections of said lighting circuit;

an abnormality detection circuit for detecting an abnormality in said discharge lamp or said lighting circuit; and switch means for permitting or stopping power supply to said individual sections of said lighting circuit from said auxiliary power supply section in accordance with a detection signal from said abnormality detection circuit, thereby permitting or inhibiting power supply to said discharge lamp, wherein a supply voltage stabilized by said auxiliary power supply section is supplied from a first terminal at an output stage thereof to said abnormality detection circuit, and a predetermined supply voltage is supplied to individual sections of said lighting circuit excluding said abnormality detection circuit from a second terminal connected to an output terminal of said switch means provided at a subsequent stage of said first terminal or the other power supply terminal of said auxiliary power supply section.

2. The lighting circuit according to claim 1, wherein said switch means enables or disables said auxiliary power supply section in accordance with said detection signal from said abnormality detection circuit to thereby permit or inhibit power supply to said discharge lamp.

3. The lighting circuit according to claim 1, wherein said switch means is a mechanical switch.

4. The lighting circuit according to claim 1 further comprising:

a DC-AC converter for converting an output of said DC power supply section to an AC voltage and supplying said AC voltage to said discharge lamp; and inhibition means for inhibiting an operation of said DC-AC converter upon reception of an abnormality detection signal from said abnormality detection circuit.

5. The lighting circuit according to claim 1, wherein said auxiliary power supply section has a smaller power capacity than said DC power supply section.

6. The lighting circuit according to claim 1, wherein said switch means is provided on a current line whose current is smaller than a current flowing on a power supply line to said discharge lamp.

7. The lighting circuit according to claim 1, wherein said abnormality detection circuit determines said abnormality based on a signal equivalent to a lamp voltage or a signal equivalent to a lamp current of said discharge lamp.

8. The lighting circuit according to claim 1, wherein said abnormality detection circuit determines said abnormality based on a directly detected lamp voltage or a directly detected lamp current of said discharge lamp.

9. The lighting circuit according to claim 3, wherein said switch means is a semiconductor switch element.

10. The lighting circuit according to claim 3, wherein said mechanical switch is a relay contact.

11. The lighting circuit according to claim 9, wherein said semiconductor switch element is an NPN transistor.

12. The lighting circuit according to claim 7, wherein said abnormality detection circuit includes battery voltage detection means for detecting if a battery voltage lies within a predetermined range, and holding means for holding said detection signal until said switch means is switched on again when an abnormality in said discharge lamp or said lighting circuit is detected.

13. The lighting circuit according to claim 8, wherein said abnormality detection circuit includes battery voltage detection means for detecting if a battery voltage lies within a predetermined range, and holding means for holding said detection signal until said switch means is switched on again when an abnormality in said discharge lamp or said lighting circuit is detected.

14. The lighting circuit according to claim 12, wherein said battery voltage detection means includes means for detecting if said battery voltage drops below a predetermined value and means for detecting if said battery voltage exceeds a predetermined value to be an overvoltage state, both detection means being provided in parallel to each other.

* * * * *

UNITED STATES PATENT AND TRADEMARK OFFICE

CERTIFICATE OF CORRECTION

PATENT NO. : 5,783,908

DATED : July 21, 1998

INVENTOR(S) : ATSUSHI TODA ET AL.

It is certified that error appears in the above-identified patent and that said Letters Patent is hereby corrected as shown below:

COLUMN 1

Line 54, "and," should read --and--.

COLUMN 2

Line 27, "invention.FIG." should read --invention.¶FIG.--; and
Line 61, "31," should read --3',--.

COLUMN 4

Line 51, "as a" should read --as--.

COLUMN 5

Line 13, "112911" should read --"29"--;
Line 15, "1129111" should read --"29'"--; and
Line 66, "IS5(34Q*)IY" should read --"S(34Q*)")--.

UNITED STATES PATENT AND TRADEMARK OFFICE

CERTIFICATE OF CORRECTION

PATENT NO. : 5,783,908

DATED : July 21, 1998

INVENTOR(S) : ATSUSHI TODA ET AL.

It is certified that error appears in the above-identified patent and that said Letters Patent is hereby corrected as shown below:

COLUMN 6

Line 34, "w hen" should read --when--.

COLUMN 11

Line 16, "claim 3," should read --claim 1,--.

Signed and Sealed this

Fourteenth Day of December, 1999

Q. Todd Dickinson

Q. TODD DICKINSON

*Acting Commissioner of Patents and Trademarks*

*Attest:*

*Attesting Officer*